United States Patent [19]

Lovering

[11] Patent Number: 4,648,484

[45] Date of Patent: Mar. 10, 1987

[54] SUPPORT ASSEMBLY

[75] Inventor: Dennis W. Lovering, Wolverhampton, England

[73] Assignee: GKN Kwikform Limited, London, England

[21] Appl. No.: 873,542

[22] Filed: Jun. 12, 1986

[30] Foreign Application Priority Data

Jun. 19, 1985 [GB] United Kingdom ..... 8515557

[51] Int. Cl.[4] ..... E04G 5/08; E04G 1/15

[52] U.S. Cl. ..... 182/222; 182/119; 182/179

[58] Field of Search ..... 182/178, 179, 119, 222, 182/230; 52/638, 637; 403/237, 235

[56] References Cited

U.S. PATENT DOCUMENTS

| | | | |
|---|---|---|---|
| 2,619,390 | 11/1952 | Johnson | 182/119 |
| 2,665,950 | 1/1954 | Johnson | 52/637 |
| 2,736,613 | 2/1956 | Jagiel | 52/637 |
| 2,760,707 | 8/1956 | Anderson | 182/179 |
| 3,454,131 | 7/1969 | Johnson | 182/178 |
| 3,565,212 | 2/1971 | Johnson | 182/179 |
| 3,628,628 | 12/1971 | Gilbreath | 182/222 |
| 4,561,165 | 12/1985 | Bayer | 182/119 |

FOREIGN PATENT DOCUMENTS

| | | | |
|---|---|---|---|
| 2945601 | 6/1981 | Fed. Rep. of Germany | 182/179 |

*Primary Examiner*—Reinaldo P. Machado

*Attorney, Agent, or Firm*—Marshall, O'Toole, Gerstein, Murray & Bicknell

[57] ABSTRACT

A support assembly for e.g. a scaffold support platform, comprises two horizontally spaced elongate elements 10 mounted between two longitudinally spaced supports 12 and 14 by means of respective hook connectors 16 and 18. The elements 10, connectors 16–18 and supports 12–14 are so dimensioned and arranged with respect to one another that upwardly directed disconnection of the connectors from their supports is prevented unless the element 10 is first deliberately displaced in a direction parallel to its longitudinal axis. Upon such displacement, the element 10 may be tilted upon one support to permit upwardly directed disconnection from the other support.

5 Claims, 4 Drawing Figures

FIG. 1.
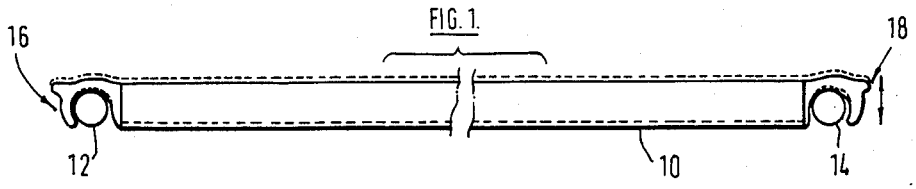
FIG. 2.
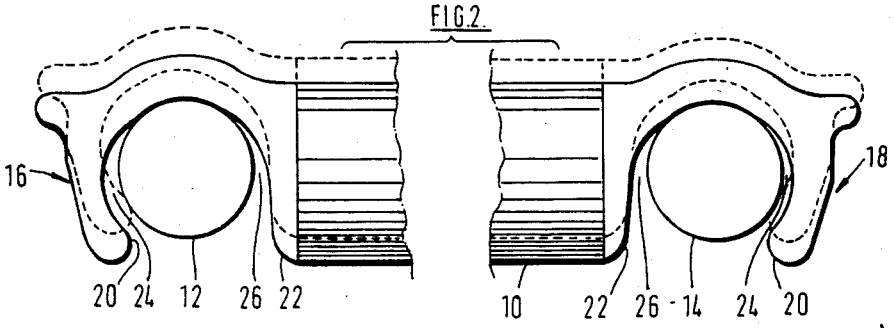
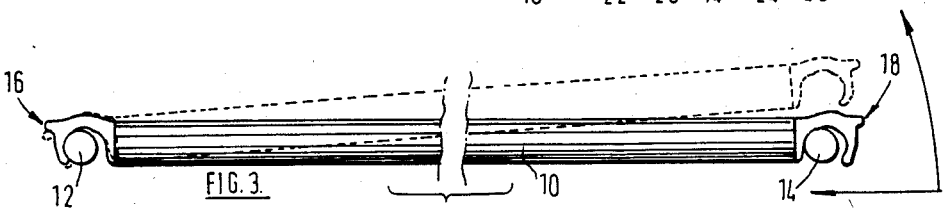
FIG. 3.
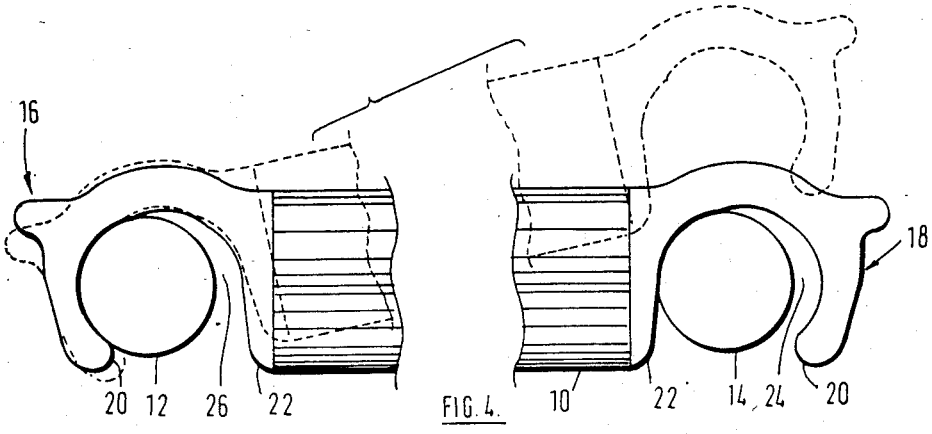
FIG. 4.

SUPPORT ASSEMBLY

This invention relates to a support assembly and particularly to an assembly of the type comprising a scaffold structure wherein a decking or platform is supported by and connected to horizontally spaced supports of the structure.

It is known to provide decking on horizontally spaced elongate elements each of which has a hook connector at each of its ends whereby such elements, and the decking, may be connected to horizontally spaced supports of scaffold structure; the supports extending perpendicular to the decking in a horizontal plane with the hooks engaged over the supports. Such an arrangement is described in British Pat. No. 2058189 wherein there is disclosed a particular form of locking hook connector designed to prevent accidental displacement of the elongate elements and decking from the supports.

However, such special locking hooks are not always utilised, and a simple hook design of connector is frequently used which merely rests over the supports thereby restraining the decking against movement parallel to the longitudinal axis of the elongate elements. It can occur in use that the weight of a person standing on the decking is applied thereto outboard of the hook connector whereby, with a simple hook, the decking may be cantilevered to pivot about that support adjacent the point at which the loading is applied or about the common longitudinal axis of hooks at opposite ends of the decking.

It is an object of the present invention to provide an improved form of support assembly which provides a quick, economic and simple means of attaching elongate elements to supports.

In accordance with the invention there is provided a support assembly comprising at least one elongate element and two horizontally spaced supports of circular exterior cross-sectional form, each end of said elongate element being provided with a connector for engagement with a respective said support for mounting the elongate element on said supports to extend therebetween substantially perpendicular thereto, each said connector having a mouth opening downwardly over a respective support and a generally arcuate re-entrant internal surface extending between the extremities of the mouth, the circumferential length of said arcuate surface being greater than half the circumference of the support and being so dimensioned and arranged with respect to the support that, when the elongate element is supported between the supports without loading applied thereto, a clearance is provided between both sides of each support and said arcuate surface of a respective connector in a plane extending through a diameter of a support parallel to the longitudinal axis of the elongate element and whereby, such position, the connectors are prevented from upwardly directed disconnection from their respective supports due to the re-entrant curvature of the arcuate surfaces of the connectors, but whereby upwardly directed disconnection of one connector from its respective support is permitted upon displacement of the elongate element in a direction parallel to its longitudinal axis to take up a said clearance between the other connector and its respective support on that side thereof remote from the other support.

The support assembly conveniently includes two said elongate elements provided in spaced horizontal relationship with one another, each said element being mounted on said supports to extend therebetween substantially perpendicular thereto. Conveniently decking is carried on and secured to said elongate elements to provide a support platform. Such decking may be integral with the elongate elements; for example, two spaced elongate elements may be formed as an aluminium extrusion with an integral web therebetween to provide the decking.

Other features of the invention will become apparent from the following description given herein solely by way of example with reference to the accompanying drawings wherein:

FIG. 1 is a diagrammatic side elevation of a support assembly in accordance with the invention showing an elongate element mounted on two horizontally spaced supports;

FIG. 2 is an enlarged view of the assembly of FIG. 1 with the connectors at each end of the elongate element shown in their mounted position on the supports and also showing, in dotted outline, how upwardly directed disconnection is prevented;

FIG. 3 is a diagrammatic side view somewhat similar to that of FIG. 1 but showing, in dotted outline, a tilted position of the elongate element for effecting upwardly directed disconnection of one connector from its respective support; and FIG. 4 is an enlarged view of the assembly of FIG. 3 showing in both full and dotted line the respective initial displaced position of the elongate element for permitting upwardly directed disconnection of one connector and the final disconnection thereof.

The support assembly described and illustrated herein comprises a single elongate element 10 and two horizontally spaced supports 12 and 14 of circular exterior cross-sectional form wherein each end of the elongate element is provided with a connector 16 and 18 for engagement with a respective said support 12 and 14. The elongate element 10 is thus mountable on said supports 12 and 14 to extend therebetween substantially perpendicular thereto as is shown in FIGS. 1 and 2.

Although only one elongate element 10 is illustrated, it will be appreciated that two said elements may be provided in spaced horizontal relationship with one another with each said element mounted on said supports 12 and 14 to extend therebetween substantially perpendicular thereto. In such a construction elements may be carried on and secured to the upper surfaces of the elongate elements, or be formed integral with said elements, to provide a support surface; in the case where the support assembly comprises part of a scaffold structure, the decking provides a working platform for scaffolding personnel.

The or each elongate element 10 is conveniently of tubular form, such as an aluminium extrusion, and the connectors 16 and 18 are each shaped with a spigot projection (not shown) whereby these are receivable within each respective end of element 10 for welding or otherwise securing in position.

Referring more particularly to FIG. 2, each connector 16 and 18 is provided with a mouth opening downwardly onto a respective support 12 and 14. The inner surface of each connector comprises a generally arcuate re-entrant internal surface extending between the two extremities 20–22 of the mouth with the circumferential length of said arcuate surface being greater than half the circumference of the support 12 or 14.

The elongate element 10, the two connectors 16–18 and the two supports 12–14 are so dimensioned and arranged with respect to one another that, when the elongate element 10 is supported between the supports 12 and 14 as shown in FIGS. 1 and 2 without any loading applied thereto respective clearances 24 and 26 are provided between each side of each support and said arcuate surface of a respective connector. Such clearances 24–26 are provided in a plane extending through a diameter of a support 12 and 14 parallel to the longitudinal axis of the elongate element 10. As is clearly shown in the dotted outline of FIG. 2, the connectors 16 and 18 are prevented from upwardly directed disconnection from their respective supports 12 and 14 due to the re-entrant curvature of the arcuate surfaces of the connectors and impingement of a connector extremity on the lower surface of a support 12–14.

However, upwardly directed disconnection of one connector 16 or 18 from its respective support 12 or 14 may be effected upon prior displacement of the elongate element 10 in a direction parallel to its longitudinal axis to take up the clearance between the other connector and its respective support on that side thereof remote from the other support. Thus, with reference to FIGS. 3 and 4, this prior displacement position is shown in full line wherein the elongate element 10 has been displaced to the right to take up the clearance 24 between the connector 16 and the left hand side of the support.

In this displaced position of the elongate element 10, the clearance 26, between the connector 18 and the left hand side of the support 14 is also taken up. Respective clearance 26 to the right hand side of connector 12 and clearance 24 to the right hand side of connector 14 are thus increased in this displaced position of the elongate element 10.

The elongate element 10 may then be pivoted upwardly about the left hand support 12, whilst connector 16 is in contact therewith, and there is sufficient clearance 24 provided between the right hand connector 18 and its support 14 to allow such connector 18 to be disconnected from the support 14 as shown in dotted outline in FIGS. 3 and 4. After disconnection of the one connector 18 it is of course a simple matter to displace the elongate element 10 to the left thereby affording clearance for disconnection of the other connector 16 from its support 12.

From the foregoing description it will be appreciated that disconnection of either connector 16 or 18 from a respective support 12 or 14 can only be effected consequent upon the deliberate displacement of the elongate element in a plane parallel to its longitudinal axis; even upon such displacement only one connector at a time can be disconnected from its respective support. When the element 10 is in its normal position, as shown in FIGS. 1 and 2, there is no possibility of accidental disconnection from either of the supports 12 or 14 even if loading is applied to the element 10 at a position outboard of the vertical centre line of a support.

The assembly of the invention therefore finds particular application as a decking support in a scaffold structure where personnel can stand on the decking to carry out their tasks without any possibility of the elements carrying the decking accidentally cantilevering upwardly at one end.

I claim:

1. A support assembly comprising at least one elongate element and two horizontally spaced supports of circular exterior cross-sectional form, each end of said elongate element being provided with a connector for engagement with a respective said support for mounting the elongate element on said supports to extend therebetween substantially perpendicular thereto, each said connector having a mouth opening downwardly over a respective support and a generally arcuate re-entrant internal surface extending between the extremities of the mouth, the circumferential length of said arcuate surface being greater than half the circumference of the support and being so dimensioned and arranged with respect to the support that, when the elongate element is supported between the supports without loading applied thereto, a clearance is provided between both sides of each support and said arcuate surface of a respective connector in a plane extending through a diameter of a support parallel to the longitudinal axis of the elongate element and whereby, in such position, the connectors are prevented from upwardly directed disconnection from their respective supports due to the re-entrant curvature of the arcuate surfaces of the connectors, but whereby upwardly directed disconnection of one connector from its respective support is permitted upon displacement of the elongate element in a direction parallel to its longitudinal axis to take up a said clearance between the other connector and its respective support on that side thereof remote from the other support.

2. A support assembly as claimed in claim 1 wherein two said elongate elements are provided in spaced horizontal relationship with one another, each said element being mounted on said supports to extend therebetween substantially perpendicular thereto.

3. A support assembly as claimed in claim 2 wherein decking is carried on and secured to said elongate elements to provide a support platform.

4. A support assembly as claimed in claim 2 wherein decking is formed integral with said elongate elements to provide a support platform.

5. A support assembly as claimed in claim 1 wherein the or each said elongate element is of tubular form and receives a said connector within each of its ends.

* * * * *